US005332127A

United States Patent [19]

White

[11] Patent Number: 5,332,127

[45] Date of Patent: Jul. 26, 1994

[54] VENTED LIQUID DISPENSER AND ATTACHMENT CAP THEREFOR

[76] Inventor: Jonathan Z. White, 2208 Falcon Hill Pl., Lynchburg, Va. 24503

[21] Appl. No.: 961,629

[22] Filed: Nov. 19, 1992

Related U.S. Application Data

[63] Continuation-in-part of Ser. No. 766,093, Sep. 27, 1991, abandoned, which is a continuation-in-part of Ser. No. 597,491, Oct. 10, 1990, abandoned.

[51] Int. Cl.[5] ..... F04F 10/00

[52] U.S. Cl. ..... 222/214; 222/416; 222/464; 222/484; 285/321; 285/354

[58] Field of Search ..... 222/214, 181, 185, 416, 222/464, 468, 481, 481.5, 484, 509, 545, 460; 215/4, 19, 308, 309, 315; 285/321, 354, 332.2

[56] References Cited

U.S. PATENT DOCUMENTS

| | | | |
|---|---|---|---|
| 119,028 | 9/1871 | Glover | 215/5 |
| 707,905 | 8/1902 | Conover | 222/416 |
| 735,295 | 8/1903 | Price | 222/416 |
| 1,171,550 | 2/1916 | Sprague | 222/185 |
| 1,287,046 | 12/1918 | Knapp | 222/416 |
| 1,837,500 | 12/1931 | Sundren | 222/185 |
| 2,344,556 | 3/1944 | Manley | 222/181 |
| 2,545,350 | 3/1951 | Fuld | 222/460 |
| 3,537,623 | 11/1970 | Fisher | 222/460 |
| 4,074,986 | 2/1978 | Frahm et al. | 222/545 |
| 4,541,537 | 9/1985 | Sailor | 215/309 |
| 4,687,122 | 8/1987 | Bothun et al. | 222/484 X |
| 4,844,290 | 7/1989 | McCurdy et al. | 222/185 |
| 4,877,159 | 10/1989 | Strand | 222/484 |
| 4,928,856 | 5/1990 | White | 222/481 |
| 4,930,689 | 6/1990 | Stumpf | 222/484 X |
| 5,042,698 | 8/1991 | Fessell | 222/484 X |

*Primary Examiner*—Gregory L. Huson

[57] ABSTRACT

A vented gravity dispenser for a liquid contained in a closed container. A clamp comprising a bevelled skirt, split compression ring and a nut are provided to sealingly attach said dispenser to said container. The present disclosure also details a dual acting valve, comprising a liquid discharge part and an air inlet part, which are co-operatively actuated.

10 Claims, 4 Drawing Sheets

24
22
8
20

9
50
12
10
7
46
48
47
3
15
28
27
26
49
2

VENTED LIQUID DISPENSER AND ATTACHMENT CAP THEREFOR

This application is a continuation-in-part of application Ser. No. 07/766,093, filed Sep. 27, 1991 now abandoned, and which in turn is a continuation-in-part of application Ser. No. 07/597,491, filed Oct. 10, 1990, now abandoned.

BACKGROUND OF THE INVENTION

1. Field of the Invention

The present invention relates to the gravity dispensing of liquids from large bottles or drums without the need for a separate vent opening. Additionally, it provides a means for conveniently and securely attaching a cap or other fitting, including a dispensing valve, to a standard crown-top bottle neck.

2. Description of Prior Art

The use of bottled water, packaged in standard bottles of 3, 5, and 6 gallon sizes is common throughout the world. Various dispensing systems are currently in use, including coolers and room temperature units wherein, typically a bottle is unsealed and inverted to rest vertically atop a reservoir. Atmospheric pressure on the open reservoir surface balances a vacuum above water in the bottle and prevents overflow. Faucets of various designs are used to dispense water from the reservoir, whose pressure is limited by vertical head between faucet outlet and open surface.

Another dispensing system employs a tilting rack into which a bottle is placed upright and swung around a horizontal pivot line somewhere near its center. This unit cannot remain balanced as the contents of the bottle are consumed, as the center of gravity is not constant. Dispensing rate is difficult to control from the typically large bottle mouth.

The commonly used dispenser system with open reservoir has been criticised for its unsealed condition when in use, and consequent airborne contamination; new systems have been advanced wherein the bottle cap remains in place while the inverted bottle is lowered into an apparatus which pierces the cap and seals around the bottle top, with a filtered vent to atmosphere. Disadvantages to these systems are added complexity and cost to the dispenser and to the bottle capping operation, as well as contamination of the reservoir by a cap which has been handled before insertion.

U.S. Pat. No. 4,928,856 discloses a dispensing system wherein a vented valve is clamped to the container mouth, whereupon the container is inverted into a supporting structure. The present invention is of a similar system but has three important advantages: 1. the threaded clamp of the present invention is easier to use and conforms to a wider range of bottle necks, and 2. a sensitive and fragile vent check valve is superceded in the present invention by a positive, internal, manually operated vent valve, and 3. production cost for the present invention is inherently lower.

SUMMARY OF THE INVENTION

The present invention provides a simple and inexpensive means for dispensing bottled water at room temperature with minimal water contamination or biofilm growth.

A vented dispenser is releasably secured to the bottle by means of a compression ring and nut combination. The bottle is then inverted and placed in a supporting structure, or in the case of the siphon tube variation, rests on its side on a table or countertop. A combination vent and discharge valve operates by channelling ambient air up through the discharge stream to release it into the bottle through a valved opening above the discharge valve.

DESCRIPTION OF THE PREFERRED EMBODIMENTS

Figure 1:
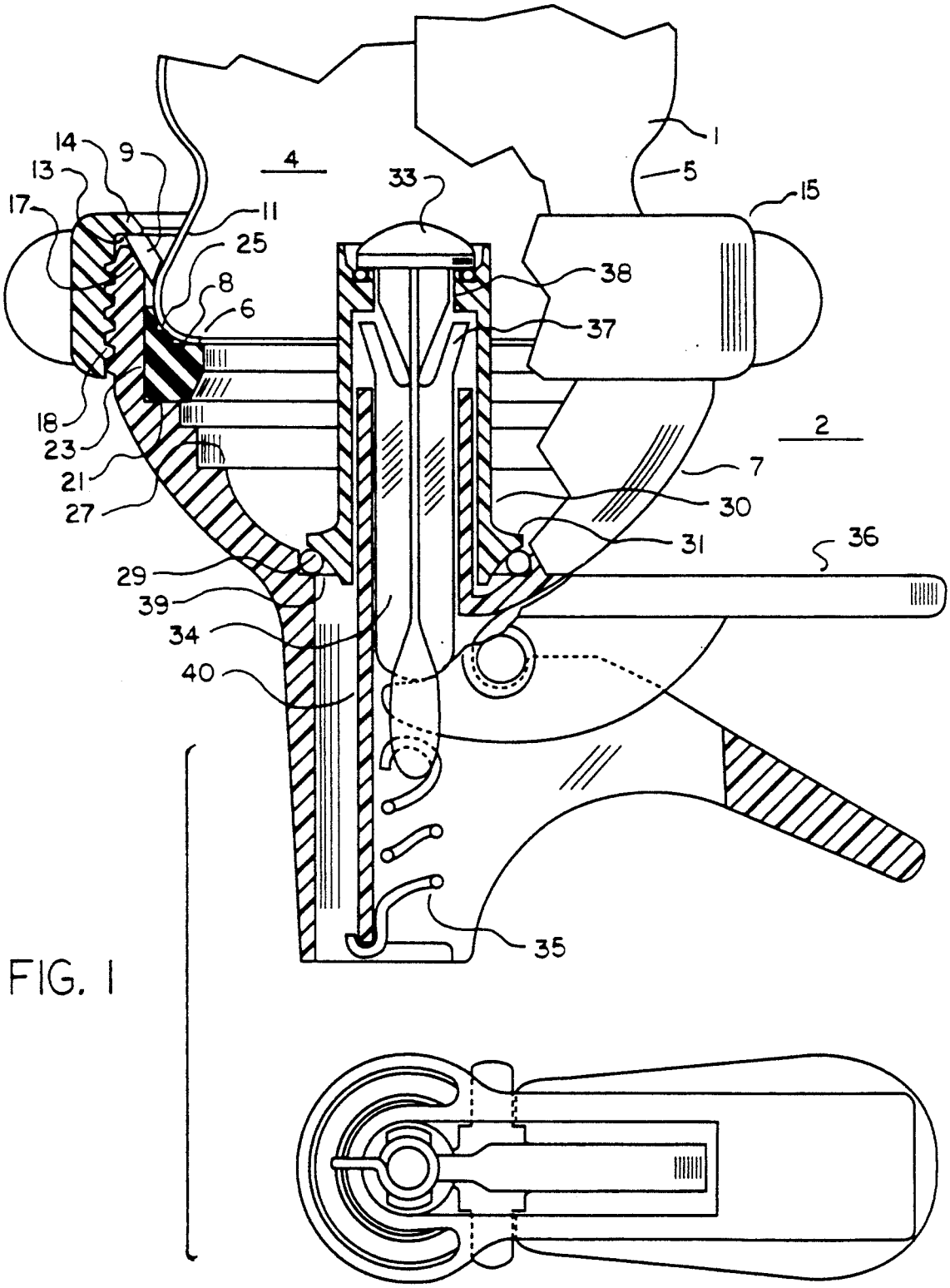
FIG. 1 is a partial cross section of a main cap and valve assembly in attachment to a container neck.

With reference to the drawings, FIG. I illustrates a vented dispenser valve assembly 2 in sealing attachment to a Liquid container 1 having an outlet 4, comprising neck 5 and mouth 6, and supported in an inverted position.

Figures 2, 3, 4, 6:
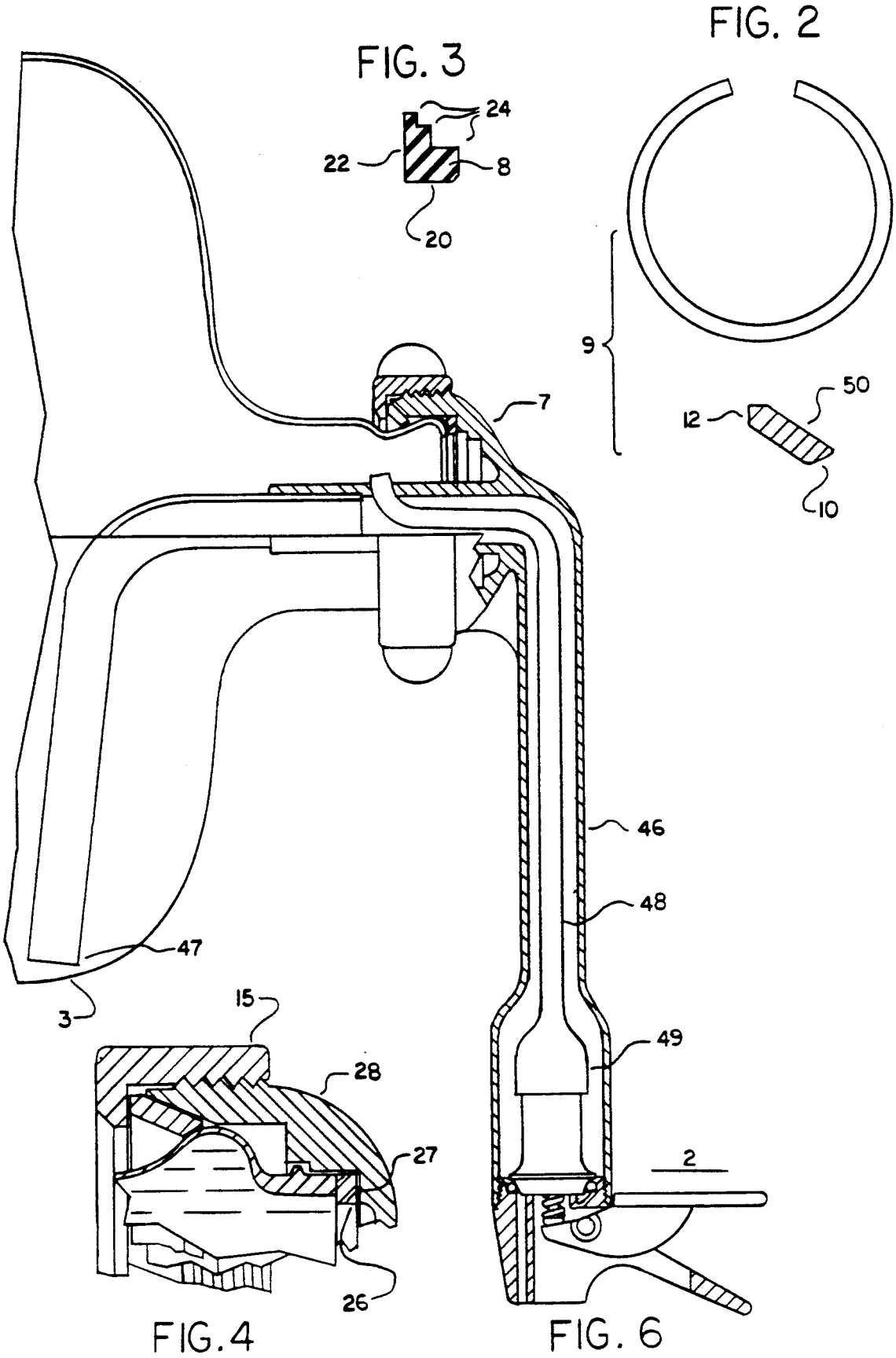
FIG. 2 is a plan view and enlarged end view of the split compression ring.
FIG. 3 is a cross-sectional view of the nesting gasket.
FIG. 4 is a detail of the valve attachment to a twist-oil neck with flat gasket.
FIG. 6 shows the siphon tube embodiment in cross-section.

The dispenser valve assembly 2 is attached to the container 1 while the container is in the upright position, accomplished in this embodiment and in the siphon tube version shown in FIG. 6, by a main cap 7, containing a nesting gasket 8, compressed into sealing contact against outlet 4 by a split compression ring 9, as shown by FIG. 2, with a downstream end surface 10 in angular contact with a conical part 11 of neck 5, and an upstream surface 12 in axial contact with an annular bearing surface 13 on a ring part 14, which extends radially inward at one end of a nut 15. The compression ring is constrained radially by bevelled open end 17 of skirt 16 bearing on outer surface 50 and is forced inward to contact with conical part 11 as it is moved axially by the action of nut 15, wherein a female threaded part 18 remains in threaded engagement with a threaded outer surface 19 on skirt 16.

Nesting gasket 8, as illustrated in cross-section by FIG. 3, is of resilient material and comprises a stepped series of concentric cylinders with a common flat basal end 20 in contact with upper step 21, a circumferential surface 22 in contact with the cylindrical inner surface 23 of skirt 16, and more than one inner edge 24, relatively positioned to contact a standard curved sealing surface 25 of mouth 6, sealing radially and axially along multiple circumferential lines of contact.

Alternatively, to accommodate a standard "twist-off" container neck design, as illustrated by FIG. 4, wherein the sealing surface is flat and of a lesser diameter, a flat gasket 26 is inserted to a flat recessed step 27 in main cap 7.

Figure 7:
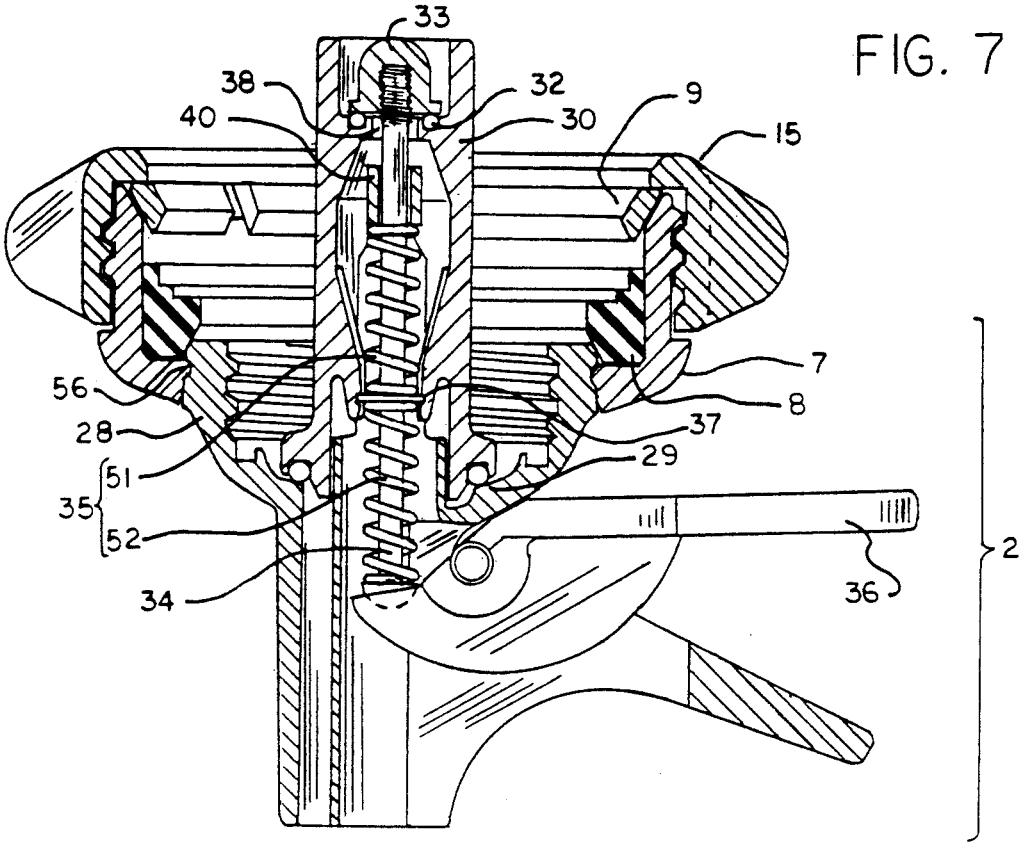
FIG. 7 is a cross-section of the valve embodiment having a two-part valve closing force exerting means, in snap-fit assembly with a main cap.

A further embodiment of the present invention is illustrated in FIG. 7 wherein valve housing 28 is threaded to fit a smaller standard threaded container neck, and is peripherally grooved as shown, to facilitate a snap fit to main cap 7. Main cap 7 in this embodiment comprises an inner lip 56, adapted to fit said grooved valve housing.

Figure 8:
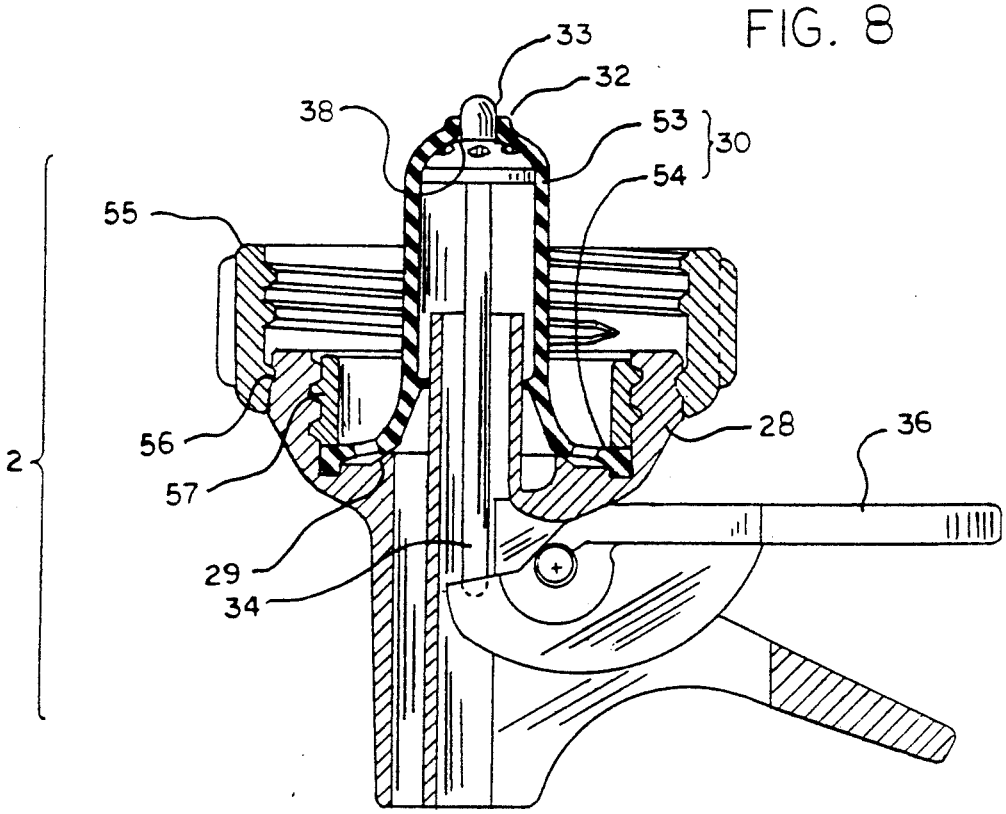
FIG. 8 shows the valve embodiment having an elastic valve member, in snap-fit assembly with a threaded cap.

A further adaptation of said valve housing, to a larger commonly used threaded container neck, may be effected by the addition of a free-rotating threaded cap 55, as illustrated in FIG. 8, open at both ends and comprising an inner lip 56.

Valve assembly 2 comprises a valve housing 28 with annular primary sealing surface 29, as illustrated in FIG. 1, and a tubular valve member 30, having a flange 31 near the downstream end, in reciprocal sealing contact with primary sealing surface 29. A vent valve seat 32 is located central to and near the upstream end of valve member 30, and is sealed closed by vent closure 33, a part of lifter 34, which is normally urged in the downstream direction by valve closing force exerting means 35, to exert a closing force on vent closure 33 and simultaneously on valve member 30.

Dispensing action is initiated by manually countering the closing force exerted by valve closing force exerting means 35 upon lifter 34 by means of handle 36, thereby opening vent closure 33. Valve member actuating means 37, in this embodiment a laterally extending part of lifter 34, then contacts valve member 30 on the downstream side, moves it axially upstream, and opens contact with primary sealing surface 29. As can be readily seen from the detail in FIG. 1, fluid will initially flow outward through both vent port 38 and main port 39. Thereafter, as pressure at vent port 38 falls below ambient, air enters through the vent port, as it is at higher elevation and therefore at lower pressure than main port 39, and replaces discharged liquid to establish a condition of steady flow.

In the present embodiment, a guide tube 40 is fixed to valve housing 28 and extends centrally upstream, interior to and in sliding engagement with valve member 30, and open to atmosphere near the downstream end. Lifter 34 slides axially within the guide tube, in actuating contact with valve member 30 near the upstream end and at vent port 38.

In the preferred embodiment of valve assembly 2, as shown in FIG. 7, positive control is maintained of relative position and rate of motion of valve member 30 and vent closure 33 by a valve closing force exerting means 35, comprising two resilient parts in opposing compressive contact with valve member actuating means 37, which in the present embodiment is rigidly fixed to said valve member. One part of valve closing force exerting means 35 is valve member closing means 51, exerting a closing force between said valve member 30 and primary sealing surface 29, and the second part is a vent closure closing means 52, exerting a closing force between vent closure 33 and valve member 30. Lifter 34 comprises a rigid axial extension of vent closure 33 in downstream compressive contact with handle 36. While valve member and vent closure are in static closed position, vent closure closing means 52 exerts an incrementally greater closing force than valve member closing means 51; as axial opening force is applied to said lifter through said handle, valve member closing means is deflected first, releasing sealing contact between valve member 30 and primary sealing surface 29 and relieving any residual pressure in container 1. Further opening force commences deflection of vent closure closing means 52 and opening motion of vent closure 33 relative to vent valve seat 32; internal pressure at vent port 38 falls below ambient, and air enters through the vent port to establish in this embodiment a condition of steady flow.

Guide tube 40 engages valve member closing means 51 near the upstream end, and longitudinal openings are provided in guide tube wall to accommodate valve member actuating means 37, which extends laterally through said guide tube to fix said valve member to said valve closing force exerting means.

A further embodiment of the present invention is shown by FIG. 8, wherein the valve member is of elastic material, and performs the added function of valve closing force exerting means. In this embodiment, an elastic tubular cylindrical part 53 extends upstream from primary sealing surface 29, and a perforated flange 54 extends radially, fixed in peripheral sealing contact with valve housing 28 by valve member retaining means 57 or by a container mouth in the alternative case when said dispenser valve assembly is applied directly to a smaller, threaded container neck. Sealing contact is maintained with primary sealing surface 29 in this embodiment by elastic extension of said perforated flange. Vent closure 33 is enclosed within the upstream end of the elastic tubular part 53, urged into sealing contact with vent valve seat 32. Axial motion of vent closure 33 transmits opening motion first to perforated flanged part 54, initiating fluid flow, and secondly forces radial enlargement of vent port 38 to a diameter sufficient to pass ambient air into container 1.

Figure 5:
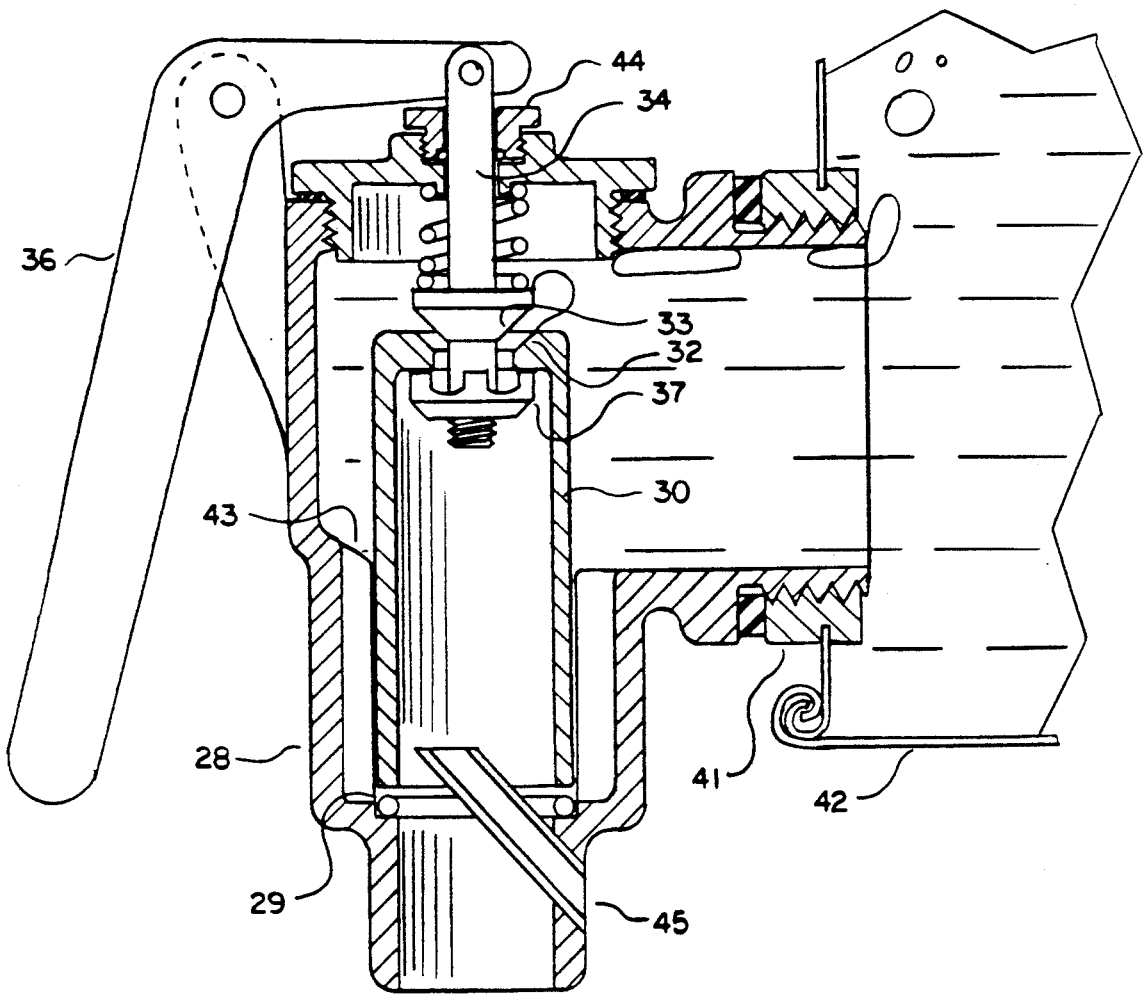
FIG. 5 is a cross-section in side view of the valve embodiment adapted to fit a standard drum.

A further embodiment of the present invention, as illustrated by FIG. 5, is in threaded, sealing attachment to and end fitting 41 in a standard drum 42, in the horizontal position. As shown in detail by the figure, valve member 30 is axially aligned in this embodiment by more than two guide vanes 43, arranged radially, parallel to fluid flow, and extending inward from the interior wall of valve housing 28 to close proximity with the valve member. Lifter 34 in this embodiment may extend upward through vent port 38 and through a sealed sliding fitting 44 to atmosphere. Air is channelled through the fluid discharge stream to the interior of tubular valve member 30 via air tube 45.

In still another embodiment, as shown by FIG. 6, a siphon tube 46 extends radially from main cap 7 beyond side wall 3 to dispenser valve assembly 2. After the main cap/siphon tube/dispenser valve assembly is fastened to container 1 in the upright position, the container is placed in a horizontal position on a table or countertop, valve assembly lowermost. Siphon tube 46 extends inside container 1 to suction end 47, in close proximity with side wall 3, at a point near the lowermost fluid depth. A vent tube 48 in this embodiment sealingly encloses vent port 37 at downstream end 49 and extends upstream, interior to siphon tube 46, to a point near the radial center of container 1, and passes through the siphon tube wall to the interior of the container, channelling ambient air inward to replace discharged liquid.

As the container is initially tipped to its side, air remains in the siphon tube; when valve assembly 2 is opened, the head of liquid above the container center forces liquid through both siphon tube and vent tube to replace air. Pressure falls within the container as main port 39 and vent port 38 are held open by lifter 34, and air is drawn again into vent tube 48 due to a difference in elevation between main port and vent port, and released inside the container to replace discharged liquid.

The foregoing is intended only to illustrate the principles of the invention. Many variations will occur to those skilled in the art; therefore, it is not desired to limit the invention to the exact forms here shown and described, and accordingly all suitable modifications and equivalents may be resorted to, falling within the scope of the invention.

I claim:

1. A liquid container in combination with a main cap, said container having side walls and an outlet comprising a mouth and a neck of standard shape, said neck having a conical part with an outside diameter increasing downstream relative to said container, said main cap removeably attached to said container mouth by means of:

a) a skirt comprising a threaded outer surface, a cylindrical inner surface sized to fit slidingly over said mouth, and an open end bevelled conically outward; and, b) a nut in threaded engagement with said skirt threaded outer surface, comprising an internal threaded surface defining a diameter and open to one end, and a ring part extending normal to said internal threaded surface and having a bearing surface facing said open one end; and, c) a split compression ring of resilient material, with a section removed to provide for decreasing diameter during compression, having a downstream outer surface in sliding contact with the bevelled open end of said skirt, an upstream end surface in circular sliding contact with the bearing surface of said ring part, and a downstream end surface of lesser diameter than said upstream end surface in angular contact with said conical part of said neck.

2. The combination of claim 1 further comprising a nesting gasket, axially positioned between said main cap and said container mouth, of resilient, elastically deformable material, with more than one inner edge, graduated in diameter and axial location to substantially conform with a standard container mouth shape, and adapted to contact a curved outlet sealing surface of said mouth both axially and radially.

3. The combination of claim 1 wherein said main cap contains a vented dispenser valve for gravity liquid dispensing from said container, said dispenser valve comprising:

a) a valve housing with an annular primary sealing surface; and, b) a tubular valve member, bearing in releasable sealing contact with said primary sealing surface; and, c) a vent valve seat, fixed to said tubular valve member upstream from said primary sealing surface, comprising a vent sealing surface peripheral to a vent port; and, d) a vent closure in releasable sealing contact with said vent valve seat; and, e) valve closing force exerting means, configured to exert a closing force on said valve member and on said vent closure;

f) a lifter, comprising a means for countering closing forces exerted by said valve closing force exerting means.

4. The combination of claim 3 also comprising a siphon tube, whereby said vented dispenser valve is positioned displaced radially from said main cap to a position beyond a container side wall to which container said cap is mounted, said siphon tube leading from a suction end interior and adjacent said container side wall, through said cap and extending radially beyond said suction end to said dispenser valve, said siphon tube further comprising a vent tube therein having a downstream end sealingly enclosing said vent valve seat, and leading upstream to a point inside said container and exterior said siphon tube.

5. A vented dispenser valve for gravity liquid dispensing from a closed container, said dispenser valve comprising:

a) a valve housing with an annular primary sealing surface; and, b) a tubular valve member, bearing in releasable sealing contact with said primary sealing surface; and, c) a vent valve seat, fixed to said tubular valve member upstream from said primary sealing surface, comprising a vent sealing surface peripheral to a vent port; and, d) a vent closure in releasable sealing contact with said vent valve seat; and, e) valve closing force exerting means, configured to exert a closing force on said valve member and on said vent closure;

f) a lifter, comprising a means for countering closing forces exerted by said valve closing force exerting means.

6. The combination of claim 5 further comprising a flange near the downstream end of said tubular valve member, extending radially outward and in axial compressional contact with said primary sealing surface, and a guide tube, fixed to said valve body, central to and concentric with said primary sealing surface, extending through said tubular valve member, said guide tube being open to atmosphere at the downstream end and in guiding engagement with said tubular valve member.

7. The combination of claim 5 further comprising a set of more than two guide vanes, oriented parallel to fluid flow and extending radially between said tubular valve member and said valve housing with clearance to provide for sliding motion of said tubular valve member between guide vanes.

8. The combination of claim 5 wherein said valve housing is adapted to mate with a horizontal opening in a standard drum.

9. The combination of claim 5 wherein said tubular valve member is of elastic material which comprises said valve closing force exerting means and a perforated flanged part extending radially, is sealingly fixed at its major periphery to said valve housing, such that resilient downstream sealing force is applied to said primary sealing surface; said tubular valve member further comprising a cylindrical tubular part extending upstream from said perforated flanged part, and a vent valve seat defining a vent port opening through the upstream end of said cylindrical tubular part, and wherein said vent closure is held in sealing contact with said vent valve seat by the force of deflection of said elastic material, and wherein as said vent closure is urged in the upstream direction an opening force is transmitted to said perforated flanged part, opening said primary sealing surface, and secondly said opening force deflects said cylindrical tubular part and breaks sealing contact between said vent closure and said vent valve seat.

10. The combination of claim 5 wherein said dispenser valve is adapted to fit more than one container neck shape:

a) said valve housing comprises an inside thread to fit a standard threaded container neck; and, b) said valve housing is grooved peripherally to accept snap-fit attachment of one of:

1) a compression ring type main cap with an inner lip sized to fit said groove; and, 2) a free-rotating threaded cap, open at both ends and having an inner lip sized to fit said groove.

* * * * *